US005289766A

United States Patent [19]

Conrad et al.

[11] Patent Number: 5,289,766

[45] Date of Patent: Mar. 1, 1994

[54] APPARATUS FOR COOLING CALENDER ROLLS AND THE LIKE

[75] Inventors: Hans-Rolf Conrad, Dormagen; Jürgen Baumeister, Mönchengladbach, both of Fed. Rep. of Germany

[73] Assignee: Kleinewefers GmbH, Krefeld, Fed. Rep. of Germany

[21] Appl. No.: 12,262

[22] Filed: Feb. 1, 1993

[30] Foreign Application Priority Data

Feb. 1, 1992 [DE] Fed. Rep. of Germany ..... 4202917

[51] Int. Cl.[5] ..... B30B 15/34; B30B 3/04; D21G 1/00

[52] U.S. Cl. ..... 100/930 RP; 34/54; 34/114; 100/99; 100/161; 162/262; 162/263; 162/361; 162/375; 374/153

[58] Field of Search ..... 100/38, 93 RP, 99, 161, 100/155 R, 162 R; 374/121, 124, 129, 153; 200/61.13; 34/54, 56, 114; 236/15 R, 15 BC; 162/262, 263, 360.2, 360.3, 361, 375, DIG. 10

[56] References Cited

U.S. PATENT DOCUMENTS

| | | | |
|---|---|---|---|
| 1,253,298 | 1/1918 | Temple et al. | 100/93 RP |
| 1,714,261 | 5/1929 | Egan et al. | 100/93 RP X |
| 3,203,678 | 8/1965 | Sawyer et al. | 100/93 RP X |
| 3,239,618 | 3/1966 | Sengel | 200/61.13 X |
| 3,254,593 | 6/1966 | Beachler | 100/38 |
| 3,257,938 | 6/1966 | Goyette | 100/93 RP |
| 3,489,344 | 1/1970 | Keyes, IV | 162/DIG. 10 X |
| 4,114,528 | 9/1978 | Walker | 100/93 RP X |
| 4,644,667 | 2/1987 | Yanagi et al. | 34/54 |
| 5,028,145 | 7/1991 | Borkenhagen et al. | 100/93 RP X |

FOREIGN PATENT DOCUMENTS

| | | |
|---|---|---|
| 283899 | 8/1970 | Austria . |
| 0235698 | 3/1991 | European Pat. Off. . |
| 3907216 | 9/1989 | Fed. Rep. of Germany . |
| 9016548 | 4/1991 | Fed. Rep. of Germany . |

*Primary Examiner*—Stephen F. Gerrity

[57] ABSTRACT

Apparatus for cooling the end portions of a calender roll which has an elastic layer adjacent its peripheral surface and wherein the central portion of the peripheral surface is overlapped by a running web of paper or other material when the calender is in use. The width of the non-overlapped portions of the peripheral surface of the roll varies when a web having a first width is followed by a web having a different second width. This could lead to damage to the roll at the non-overlapped portions of the peripheral surface as a result of overheating by an adjacent rotary component of the calender. The end portions of the roll are cooled by discrete adjustable cooling devices which are movable along the respective non-overlapped portions of the peripheral surface in parallelism with the axis of the roll and each of which shares movements with a monitoring device which is to be maintained in a selected position relative to the adjacent marginal portion of a running web. To this end, the monitoring devices transmit signals to discrete reversible motors which move the monitoring devices along the respective non-overlapped portions of the peripheral surface and are brought to a halt when the monitoring devices assume their selected positions.

17 Claims, 3 Drawing Sheets

Fig.1
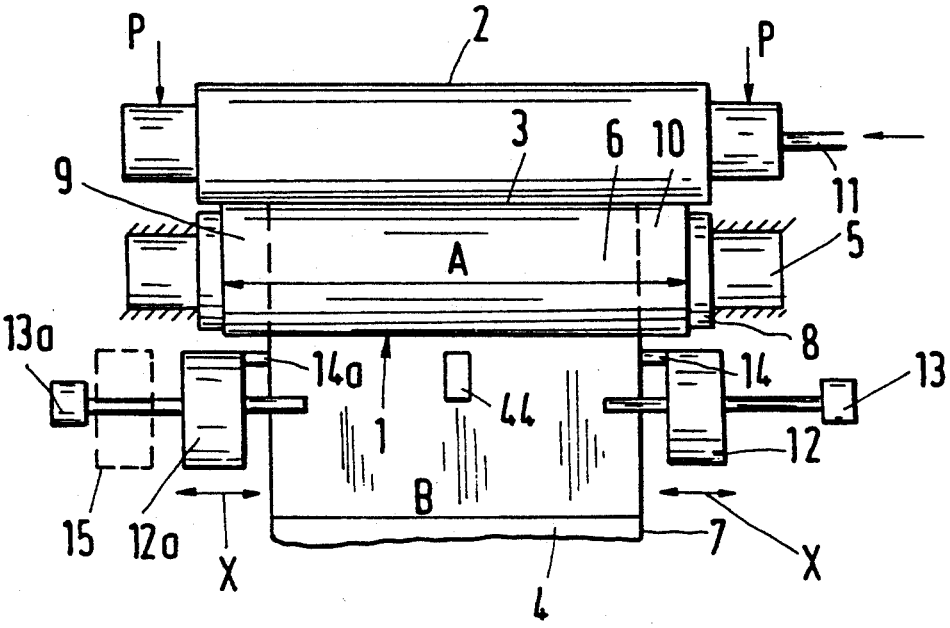
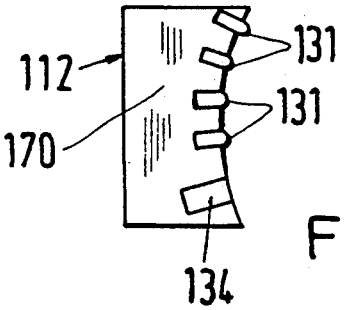
Fig. 4
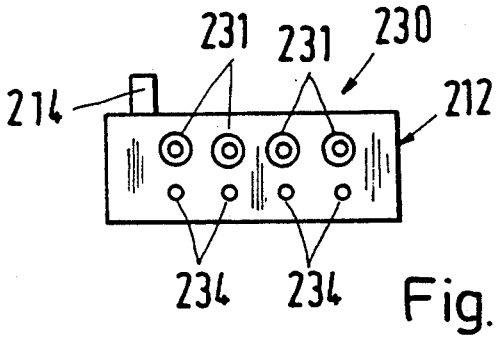
Fig.5
Fig.6
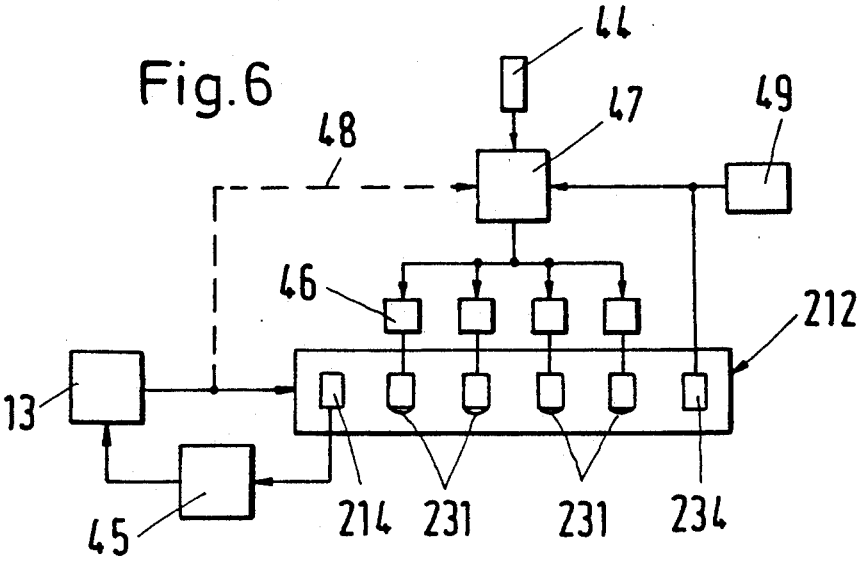

APPARATUS FOR COOLING CALENDER ROLLS AND THE LIKE

BACKGROUND OF THE INVENTION

The invention relates to machines for the manipulation of running webs of paper, metallic foil, plastic foil, magnetic tape, textile, laminates and/or other strip-shaped materials. More particularly, the invention relates to improvements in apparatus for thermally influencing selected portions of certain rolls in calenders and like machines. The following description will refer primarily to calenders for the treatment of paper webs; however, the improved apparatus can be put to use with equal or similar advantage in machines wherein pairs or larger groups of rolls are employed to advance, compress, influence the gloss and/or other characteristics of, or otherwise manipulate running webs or strips of flexible material other than paper or including paper and one or more other materials.

Many calenders employ pairs or larger groups of parallel rolls defining nips for running paper webs. The width of a nip is normally or preferably such that the machine can properly manipulate relatively narrow webs, relatively wide webs as well as webs of medium width. As a rule, a running web is guided in such a way that its marginal portions are spaced apart from the respective ends of the peripheral surfaces of the rolls so that a portion of the peripheral surface at each end of the roll is not overlapped by the running web. This can present serious problems in calenders wherein running webs are to be treated by heated rolls, for example, by one pair or by two or more pairs of rolls wherein one roll of each pair is a steel roll (finishing roll) which is heated to an elevated temperature and the other roll of each pair is an elastic roll (pressure roll), i.e., a roll wherein at least a certain layer adjacent the peripheral surface can yield at the nip of the two rolls constituting the respective pair. The elastic roll cannot stand elevated temperatures above a certain value. However, the running web constitutes an effective thermal insulator between the heated roll and that portion of the elastic roll which is overlapped by the running web. Thus, the end portions of an elastic roll are much more likely to be overheated than the median portion which is separated from the heated roll by the running web when the calender is in actual use.

Attempts to prevent overheating of end portions of elastic rolls include the provision of stationary cooling devices at the ends of an elastic roll. Such stationary cooling devices can employ nozzles which discharge jets or streams of compressed air, plenum chambers (boxes) with outlets for compressed air, nozzles which discharge several different coolants, atomizing nozzles and others. Such stationary cooling devices are satisfactory if the width of running webs is constant, i.e., if the width of successively manipulated webs is the same or at least close to an optimum value for a particular setup of cooling devices in the calender. However, the effectiveness of stationary cooling devices is much less satisfactory if the widths of successively manipulated webs are different or if the position of a running web having a satisfactory width changes in a direction toward the one or the other end of the peripheral surface of an elastic roll. This leads to overheating of the one or the other end portion of the peripheral surface of an elastic roll and can cause serious damage to the elastic layer or layers. Thus, if the width of the non-overlapped portion of the peripheral surface at one end of an elastic roll is greatly increased, the respective stationary cooling device is incapable of adequately cooling the exposed end portion of the roll and the elastic layer or layers at the respective end of the elastic roll are destroyed as a result of overheating.

U.S. Pat. No. 3,254,593 granted Jun. 7, 1966 to Beachler discloses a gloss calender drive system and method. The patentee proposes to internally cool elastic pressure rolls with water as well as to cool by a cold air blast those edge portions of the pressure rolls which extend beyond the width of the running sheet or web in order to protect the uninsulated rubber covering of the rolls from the heat radiated by the finishing rolls. In lieu of resorting to such air blasts, the patentee also proposes to taper the outward edges of the pressure rolls outwardly so as to avoid contact between the end portions of pressure rolls and the adjacent portions of the heated finishing rolls. The Beachler reference does not show and/or suggest any particular mounting for the device or devices which are to direct a cold air blast against the edge portions extending beyond the width of the sheet or web.

German patent application Serial No. 39 07 216 A1 of Kalliola (published Sep. 28, 1989) discloses a calender wherein the pressure rolls are protected from overheating by the adjacent finishing rolls in that the width of the running webs exceeds the axial length of the pressure rolls, i.e., the entire peripheral surface of each pressure roll is overlapped by the running web. Kalliola proposes to trim the marginal portions of the web when the treatment is completed, i.e., the width of the web which is to be treated must considerably exceed the required width of the finished web. Such proposal is not entirely satisfactory because it entails much waste in valuable web material.

OBJECTS OF THE INVENTION

An object of the invention is to provide an apparatus which can adequately condition a roll in a calender or a like machine irrespective of the width of the web which is being treated in the machine.

Another object of the invention is to provide an apparatus which can be utilized with particular advantage to avoid damage to the end portions of elastic rolls, such as pressure rolls of the type used in calenders for webs of paper or other sheet material.

A further object of the invention is to provide a simple and compact apparatus which can be installed in existing machines to protect from thermally induced damage those portions of rolls which are not overlapped by running webs of paper or the like.

An additional object of the invention is to provide the apparatus with novel and improved means for maintaining the temperature of the end portions of elastic rolls within an optimal range as regards the treatment of running webs as well as concerning the useful life of the rolls.

Still another object of the invention is to provide a novel and improved method of manipulating cooling devices for elastic rolls in calenders and like machines.

A further object of the invention is to provide an apparatus which can automatically alter the conditioning action upon elastic rolls for the treatment of running webs of paper, textile, metallic foil, plastic foil or composite webs consisting of two or more superimposed layers of identical material or different materials.

Another object of the invention is to provide a calender or an analogous machine which embodies, or is combined with, one or more apparatus of the above outlined character.

An additional object of the invention is to provide a novel and improved combination of temperature sensing, monitoring and/or ascertaining devices for use in the above outlined apparatus.

Still another object of the invention is to provide a simple, compact and inexpensive apparatus which occupies little room in a calender or a like machine and whose conditioning action can be regulated with a high degree of accuracy.

A further object of the invention is to provide a method of prolonging the useful life of elastic pressure rolls in calenders and like machines for the manipulation of webs of paper, textile, foil or other sheet material.

Another object of the invention is to provide an apparatus which can satisfy the above outlined objects without any waste in web material.

SUMMARY OF THE INVENTION

The invention is embodied in an apparatus which can be put to use in a machine (such as a calender) wherein running webs (such as webs of paper, metallic foil, plastic foil, magnetic tape, textile or other sheet material) having pairs of longitudinally extending marginal portions and different widths at least partially overlap a peripheral surface extending between two ends of a roll which is rotatable about a predetermined axis and the width of the non-overlapped portion of the peripheral surface at least at one end of the roll varies when a web having a first width is followed by a web having a different second width. The improved apparatus serves to thermally influence the roll at the non-overlapped portion of the peripheral surface and comprises guide means defining a path extending in substantial parallelism with the axis of the roll, and means for cooling the roll at the non-overlapped portion of the peripheral surface. The cooling means is movable along the path, and the apparatus further comprises means for monitoring those marginal portions of running webs which are adjacent the non-overlapped portion of the peripheral surface of the roll. The monitoring means is movable along the path with the cooling means and includes means for generating signals denoting the position of the monitoring means relative to that marginal portion of a running web which is adjacent the non-overlapped portion of the peripheral surface of the roll. Still further, the apparatus comprises means for moving the cooling means and the monitoring means along the path in response to signals from the monitoring means until the monitoring means assumes a predetermined position relative to that marginal portion of the monitored web which is adjacent the non-overlapped portion of the peripheral surface of the roll.

The apparatus can be employed with particular advantage to thermally influence a roll having an elastic layer adjacent its peripheral surface.

The cooling means preferably is, or can be, disposed between the monitoring means and the one end of the roll (as seen in the axial direction of the roll).

The cooling means is preferably adjustable, and such apparatus preferably further comprises means for measuring the temperature of the roll at the non-overlapped portion of the peripheral surface. Such temperature measuring means is movable with the cooling means and includes means for generating second signals denoting the measured temperature of the roll at the non-overlapped portion of the peripheral surface, and the apparatus embodying such measuring means further comprises means for adjusting the cooling means in response to the second signals, preferably in such a way that the temperature of the roll at the non-overlapped portion of the peripheral surface is maintained within a predetermined range.

The temperature measuring means can include at least one source of infrared radiation; for example, the measuring means can comprise one or more cameras which operate with infrared light.

The apparatus can further comprise means for sensing the temperature of the roll in the region of overlapped portion of the peripheral surface, and such sensing means can comprise means for generating third signals denoting the temperature of the roll in the region of overlapped portion of the peripheral surface. The means for adjusting the cooling means then preferably comprises means for adjusting the cooling means as a function of variations of the second and/or third signals. The sensing means can be provided in addition to or in lieu of the temperature measuring means.

Still further, the apparatus can comprise means for ascertaining the temperature of the roll at the non-overlapped portion of the peripheral surface, and such ascertaining means can include means for generating a detectable (e.g., visible or audible) signal when the ascertained temperature exceeds a preselected value. The ascertaining means can but need not form part of or constitute the aforediscussed temperature measuring means.

The cooling means can comprise a plurality of independently activatable and deactivatable cooling units. The adjusting means of such apparatus can be designed to adjust the cooling means (in response to the second and/or third signals) in such a way that the number of activated cooling units is a function of the measured temperature of the roll at the overlapped and/or non-overlapped portion of the peripheral surface.

Alternatively, the cooling means can comprise a plurality of individually activatable and deactivatable cooling units which are spaced apart from one another in the axial direction of the roll (for example, the cooling units can form one or more rows extending in parallelism with the axis of the roll), and such apparatus preferably further comprises means for activating different numbers of cooling units in different positions of the cooling means relative to the path.

The means for moving the cooling means and the monitoring means (as well as the temperature measuring means if the apparatus employs temperature measuring means) preferably comprises a common support for the monitoring and cooling means (and for the temperature measuring means if such measuring means is used in the apparatus), and means for moving the support along the path. The means for moving the support along the path can include a motor (e.g., a reversible linear electric motor) having a rotary output element provided with an external thread in mesh with the internal thread of a portion of the support. The output element can constitute or include a rotary feed screw which extends in parallelism with the axis of the roll and mates with a nut of the support.

The means for moving the cooling means and the monitoring means (and the temperature sensing and/or temperature measuring means if used in the improved apparatus) along the path (preferably but not necessarily with the aforediscussed support) can include means for moving the support or the aforediscussed temperature sensing means, temperature measuring means and/or cooling and monitoring means to inoperative positions in which the one end of the roll is located between the peripheral surface and the support or, in the absence of a support, at least one of the cooling and monitoring means.

If the improved apparatus is to be used in a machine (such as a calender) wherein the peripheral surface of the roll has a non-overlapped portion at each end of the roll and the width of each non-overlapped portion varies when a web having a first width is followed by a web having a different (greater or lesser) second width, the apparatus further comprises second guide means defining a second path extending in substantial parallelism with the axis of the roll along the other non-overlapped portion of the peripheral surface (namely, the non-overlapped portion which is adjacent the other end of the roll), and second cooling means movable along the second path and including means for cooling the roll at the other non-overlapped portion of the peripheral surface, and second monitoring means including means for monitoring those marginal portions of running webs which are adjacent the other non-overlapped portion of the peripheral surface. The second monitoring means is movable with the second cooling means and includes means for generating signals denoting the position of the second monitoring means relative to that marginal portion of a running web which is adjacent the other non-overlapped marginal portion of the peripheral surface. Such apparatus further comprises second moving means including means for moving the second cooling means and the second monitoring means along the second path in response to signals from the second monitoring means until the second monitoring means assumes a predetermined position relative to that marginal portion of the monitored web which is adjacent the other non-overlapped portion of the peripheral surface of the roll.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 1 is a fragmentary schematic front elevational view of a calender with two apparatus which embody the invention and each of which is designed and mounted to thermally influence one end portion of an elastic roll;

FIG. 4 is a schematic end elevational view of a portion of a modified apparatus wherein the cooling means employs a series of discrete cooling units extending in the circumferential direction of the elastic roll;

FIG. 5 is a schematic elevational view of a portion of a third apparatus wherein the cooling units of a multiple-unit cooling device form a row extending in parallelism with the axis of the elastic roll; and FIG. 6 is a circuit diagram of the means for operating an apparatus which embodies the structure of FIG. 5.

DESCRIPTION OF PREFERRED EMBODIMENTS

Figure 2:
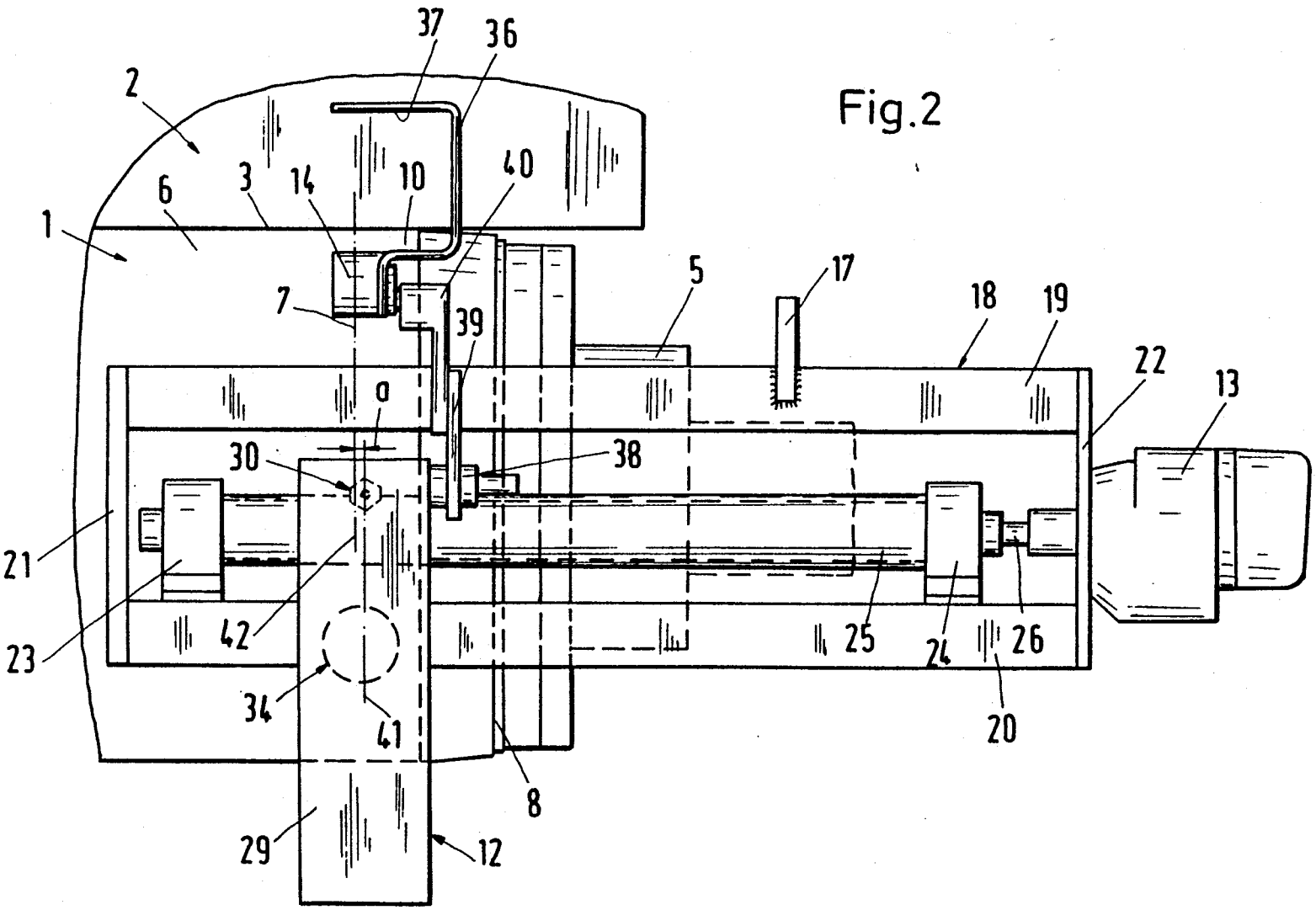
FIG. 2 is an enlarged view of a detail in the structure of FIG. 1, showing one of the apparatus with the cooling, monitoring and temperature measuring means adjacent the right-hand end portion of the elastic roll.
Figure 3:
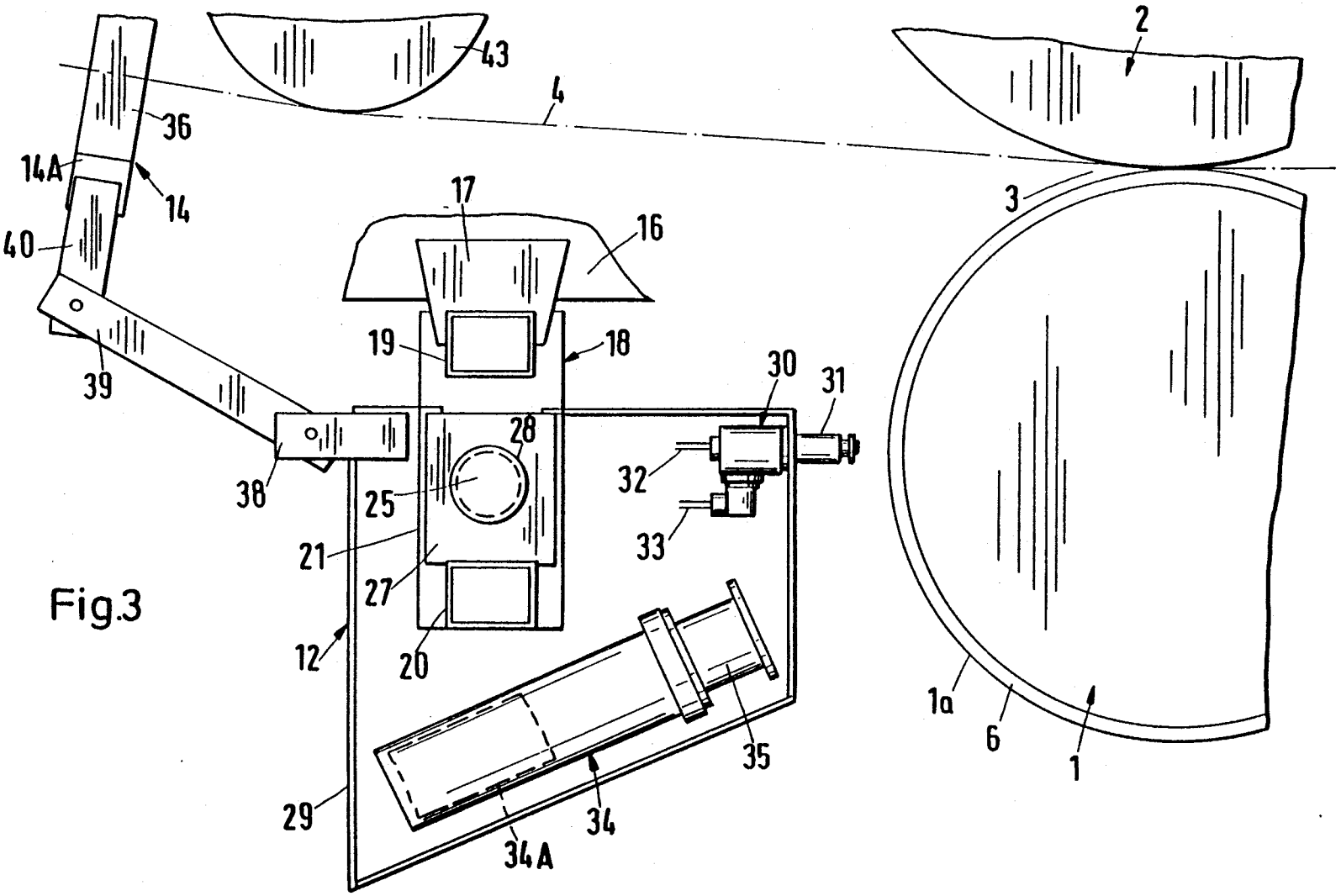
FIG. 3 is an end elevational view of the structure which is shown in FIG. 2, with the motor of the means for moving the support omitted.

Referring first to FIGS. 1 to 3 there is shown a portion of a calender including an elastic pressure roll 1 and a metallic finishing roll 2. The two rolls define a nip 3 for a running web 4 of paper or other sheet material. The width B of the illustrated web 4 is less than the axial length A of the cylindrical peripheral surface 1*a* of the roll 1. The latter includes a hollow cylindrical elastic layer 6 which surrounds the centrally located core 8 of the roll 1 and is surrounded by the peripheral surface 1*a*. The rolls 1 and 2 can be used to enhance the smoothness and/or the gloss of the running web 4.

The ends 1*b*, 1*c* of the roll 1 are provided with trunnions 5 which are rotatable in bearings (not specifically shown) in the frame 16 of the calender. The roll 1 is rotatable about a fixed horizontal axis D. The finishing roll 2 is heated from within (FIG. 1 shows a portion of a conduit 11 which supplies a heated fluid into the interior of the roll 2) and the trunnions 2*a* at the axial ends of the roll 2 are biased in directions indicated by arrows P so that successive increments of the running web 4 are acted upon by heat and pressure during advancement through the nip 3.

Since the width B of the illustrated web 4 is less than the axial length A of the peripheral surface 1*a* (i.e., less than the axial length of the elastic layer 6), at least one of the two end portions of the peripheral surface 1*a* is not overlapped by the web when the calender is in actual use. FIG. 1 shows that the peripheral surface 1*a* has two non-overlapped portions 9, 10 which are respectively adjacent the ends 1*c*, 1*b* of the layer 6 and have identical or nearly identical widths (as seen in the direction of the axis D). Thus, the heated roll 2 can directly heat the non-overlapped portions 9, 10 of the peripheral surface 1*a* while the running web 4 shields the overlapped median or central portion of the layer 6 from overheating by the roll 2. In the absence of any undertakings to the contrary, direct transfer of heat from the finishing roll 2 to the end portions of the layer 6 (namely to those portions of the layer 6 which are surrounded by the non-overlapped portions 9 and 10 of the peripheral surface 1*a* of the roll 1) would result in rapid overheating and eventual destruction of the layer 6. This would necessitate prolonged stoppage of the calender for the purpose of replacing the illustrated roll 1 with a fresh roll.

Overheating of the end portions of the elastic layer 6 could be avoided in a relatively simple manner if the width of the non-overlapped portions 9, 10 of the peripheral surface 1*a* would remain unchanged. Thus, the problem could be solved by installing a first stationary cooling device next to the non-overlapped portion 9 and a second stationary cooling device next to the non-overlapped portion 10 of the peripheral surface 1*a*. However, a calender is normally designed to manipulate running webs having different widths B so that the width of the non-overlapped portion 9 and/or 10 is changed accordingly when a relatively wide web 4 is followed by a narrower web or vice versa. Furthermore, it happens again and again that a running web 4 migrates in a direction from the end 1b toward the end 1c of the roll or in the opposite direction so that the width of the non-overlapped portions 9, 10 of the peripheral surface 1a varies even though the width B of a running web 4 is constant and matches or at least closely approximates the width of the previously treated web.

In accordance with a feature of the present invention, the calender is provided with two apparatus which are designed to thermally influence the two end portions of the roll 1 and more specifically those end portions of the elastic layer 6 which are surrounded by the non-overlapped portions 9, 10 of the peripheral surface 1a. Since the two apparatus are, or can be, mirror images of each other with reference to a plane which is normal to the axis D and is disposed midway between the ends 1b, 1c of the roll 1, FIGS. 1 to 3 merely show all necessary details of the apparatus which is designed to prevent overheating of that end portion of the elastic layer 6 which is surrounded by the non-overlapped portion 10 of the peripheral surface 1a. The non-overlapped portion 10 extends between the end 1b of the roll 1 and the adjacent longitudinally extending marginal portion 7 of the running web 4. The other non-overlapped portion 9 of the peripheral surface 1a extends between the end 1c of the roll and the other longitudinally extending marginal portion 7a of the running web 4.

The right-hand apparatus of FIG. 1 (the details of which are shown in FIGS. 2 and 3) includes an adjustable cooling device 30 which is movable along a horizontal path in parallelism with the axis D by a moving means including a prime mover 13. This apparatus further comprises a device 14 which serves to monitor the position of the marginal portion 7 of the web 4 and to transmit to the controls for the prime mover 13 signals denoting the detected position of the marginal portion 7. The arrangement is such that the prime mover 13 ceases to move the monitoring device 14 and the cooling device 30 in parallelism with the axis D (in a direction toward or away from the end 1c of the roll 1) when the monitoring device 14 reaches a predetermined position relative to the marginal portion 7, for example, when the device 14 is in exact alignment with the marginal portion 7 (as seen at right angles to the axis D). In order to simplify the construction of the apparatus and to ensure that the positions of the devices 14, 30 relative to each other remain unchanged when the apparatus of FIGS. 2 and 3 is in actual use, such apparatus preferably comprises a support 12 which receives motion from a rotary output element 25, 26 of the prime mover 13 and serves to move the devices 14, 30 as a unit in directions indicated by a double-headed arrow X. The means for confining the support 12 to reciprocatory movements in directions indicated by the double-headed arrow X includes a guide 20 forming part of a holder 18 mounted on the machine frame 16 by plate-like connectors 17 one of which is shown in each of FIGS. 2 and 3.

The other apparatus comprises a prime mover 13a, a support 12a, a monitoring device 14a for the left-hand marginal portion 7a of the running web 4 (as viewed in FIG. 1), and a cooling device (not shown) preferably corresponding to the cooling device 30 of the apparatus which is shown in FIGS. 1 to 3. The prime mover 13a can move the support 12a back and forth in directions indicated by a double-headed arrow X'.

When the calender is arrested, e.g., for the purpose of threading a fresh web 4 through the nips between pairs or between larger groups of rolls forming part of such machine, the control circuits for the prime movers 13, 13a preferably receive signals to initiate a movement of each of the two supports 12, 12a to a predetermined inoperative or parking position. The parking position of the support 12a is indicated in FIG. 1 by broken lines, as at 15. When the supports 12, 12a assume their parking positions, the two apparatus are out of the way so that they do not interfere with access to the nip 3. The arrangement is preferably such that, when an apparatus assumes its parking position, the corresponding support 12 or 12a is spaced apart from the respective end of the roll 1. Thus, the support 12 of FIG. 1 is then located to the right of the end 1b and the support 12a is located to the left of the end 1c of the roll 1.

The prime movers 13, 13a are preferably controlled in such a way that the two supports 12, 12a move to their parking positions in automatic response to stoppage of the calender and/or in automatic response to breaking or tearing of a running web 4. Once the supports 12, 12a assume their parking positions, the corresponding apparatus cannot interfere with the threading of a fresh web 4 and/or with access to the rolls 1, 2 for the purposes of inspection, repair or replacement. The supports 12, 12a can automatically return to the positions which are shown in FIG. 1 by solid lines when the calender is restarted and a properly introduced web 4 is running through the nip 3 of the rolls 1 and 2.

Referring more specifically to FIGS. 2 and 3, the holder 18 on the plates 17 of the frame 16 includes two elongated beams 19, 20 and two end walls 21, 22 connecting the ends of the beams to one another. The lower beam 20 constitutes the aforementioned guide which defines a horizontal path for the support 12, and such path is parallel to the axis D of the roll 1. The means for moving the frame 12 along the beam or guide 20 includes the prime mover 13 which is affixed to the end wall 22. The output shaft 26 of the prime mover 13 is of one piece with or is separably connected to a feed screw 25 having end portions rotatably journalled in spaced apart bearings 23, 24 on the beam 20. The feed screw 25 mates with a nut 12A forming part of or installed in the support 12.

The support 12 further includes a carriage 27 which is slidably guided by the beam 20 and includes the nut 12A. The latter has an internal thread 28 in mesh with the external thread of the feed screw 25. Still further, the support 12 includes a casing or housing 29 which is mounted on or forms part of the carriage 27 and mounts the aforementioned cooling device 30, the aforementioned monitoring device 14 and a temperature measuring device 34. The cooling device 30 in the apparatus of FIGS. 2 and 3 includes a single cooling unit 31 having or constituting a nozzle connected to a conduit 32 serving to supply a compressed gaseous fluid (such as air) and a conduit 33 serving to supply a pressurized liquid (such as water). The temperature measuring device 34 is designed to ascertain the temperature of that portion of the roll 1 which is surrounded by the non-overlapped portion 10 of the peripheral surface 1a. The illustrated temperature measuring device 34 includes a camera 35 which operates with a source 34A of infrared radiation. The monitoring device 14 tracks the adjacent marginal portion 7 of the running web 4 and includes a signal generating unit 14a serving to transmit signals which are indicative of the position of the device 14 relative to the marginal portion 7. The signal generating unit 14a can include or constitute an optoelectronic receiver or transducer which is exposed to radiation reflected by a reflector 37 mounted on a bracket 37 or on another suitable carrier. The sensor 14*a* and the carrier 37 for the reflector 36 are articulately connected to the housing or casing 29 of the support 12 by a linkage including the components 38, 39 and 40.

FIG. 2 shows that the center of the temperature measuring device 34 and the center of the nozzle 31 of the cooling device 30 are located in or close to a first vertical plane 41, and that the center of the signal generating unit 14*a* of the monitoring device 14 is located in a second vertical plane 42 which is slightly offset (note the distance a) relative to the plane 41 in a direction toward the end 1*c* of the roll 1.

When the apparatus of FIGS. 2 and 3 is in use, signals which are generated by the unit 14*a* are transmitted to the controls for the prime mover 13 so as to move the support 12 along the beam 20 until the monitoring device 14 assumes a predetermined position relative to the marginal portion 7 of the running web 4. This places the cooling device 30 in an optimum position for conditioning of the adjacent end portion of the roll 1, namely of that portion of the elastic layer 6 which is surrounded by the non-overlapped portion 10 of the peripheral surface 1*a*. The arrangement can be such that the center of the signal generating unit 14*a* of the monitoring device 14 is then exactly in line with the marginal portion 7 of the running web 4 (see FIG. 2). The cooling action of the device 30 is regulated in response to signals from the output of the temperature measuring device 34 which senses the temperature of the adjacent end portion of the elastic layer 6, i.e., of that portion which is surrounded by the non-overlapped portion 10 of the peripheral surface 1*a*. If the marginal portion 7 moves toward the end 1*b* or 1*c* of the roll 1, i.e., if the width of the non-overlapped portion 10 of the peripheral surface 1*a* changes (either as a result of migration of a running web in the direction of the axis D or following the replacement of a web 4 having a first width B with a web having a greater or lesser second width), the monitoring device 14 detects the change of the position of the marginal portion 7 relative to the plane 42. This causes the unit 14*a* to transmit signals which induce the control circuit for the prime mover 13 to start the prime mover 13 and to operate the prime mover for the purpose of shifting the support 12 to a position in which the marginal portion 7 and the center of the unit 14*a* are again located in a common plane extending at right angles to the axis D of the roll 1. Thus, the support 12 simply follows the marginal portion 7 in order to maintain the cooling unit 31 in an optimum position to adequately cool the entire exposed end portion of the roll 1, i.e., that portion of the elastic layer 6 which is surrounded by the non-overlapped portion 10 of the peripheral surface 1*a*. At the same time, the device 34 monitors the temperature of the non-overlapped portion 10 and generates signals which are used to regulate the cooling action of the device 30 upon the adjacent end portion of the elastic layer 6.

The conduits 32, 33 can constitute flexible hoses which connect the nozzle 31 with a source of compressed gaseous fluid and with a source of pressurized hydraulic fluid, respectively. Analogously, the prime mover 13 (which is assumed to constitute a reversible electric motor) is connected to a suitable source of electrical energy by a flexible cable, not shown. This renders it possible to move the support 12 along the beam 20 without disconnecting the nozzle 31 from the two fluid sources and without disconnecting the prime mover 13 from the source of electrical energy. Furthermore, this renders it possible to reduce the bulk and weight of the improved apparatus because the support 12 need not carry any source of fluid and/or a source of electrical energy. The hoses for gaseous and hydraulic fluids and the cable which connects the prime mover 13 with an energy source can be held together by a chain or the like, not shown.

FIG. 3 shows that the marginal portion 7 of the running web 4 need not be monitored in immediate or close proximity to the nip 3 of the rolls 1 and 2. In order to ensure that the marginal portion 7 will advance in a predictable manner on its way toward and into the nip 3, the calender which embodies the rolls 1, 2 can be further provided with a guide roller 43 which is contacted by successive increments of the running web 4 between the reflector 36 of the monitoring device 14 and the nip 3.

Referring again to FIG. I, the reference character 44 denotes a further temperature measuring or sensing device which serves to sense the temperature of that (median) portion of the elastic layer 6 which is overlapped by the running web 4. The output of the temperature measuring or sensing device 44 transmits a signal which serves as a reference value for regulation of the temperature of the two end portions of the elastic layer 6, i.e., of those end portions which are surrounded by the non-overlapped portions 9, 10 of the peripheral surface 1*a*.

FIG. 4 shows that the cooling device 130 on a support 112 can comprise several discrete cooling units 131, e.g., a set of four nozzles which can discharge a gaseous and/or a hydraulic coolant. The support 112 further carries a temperature measuring device 134 which is or can be a functional and structural equivalent of the temperature measuring device 34. The intensity of the cooling action upon the adjacent end portion of the elastic layer 6 (not shown in FIG. 4) can be regulated by activating one, two, three or all four nozzles 131 (each of these nozzles is assumed to be constructed in the same way as described in connection with the nozzle 31 shown in FIG. 3). Activation or deactivation of nozzles 131 is effected in response to signals from the temperature measuring device 134.

FIG. 5 shows a portion of a third apparatus wherein the individually activatable and deactivatable cooling units 231 of a composite cooling device 230 are mounted on the support 212 in such a way that they form one or more rows extending in the direction of the axis D of the roll 1 (not shown in FIG. 5). The four cooling units 231 (e.g., nozzles corresponding to the nozzle 31 of FIG. 3) can form a single row which is parallel to the axis of the roll 1. The temperature measuring device in the apparatus embodying the structure of FIG. 5 includes four discrete temperature measuring units 234, one for each cooling unit 231. FIG. 5 further shows a monitoring device 214 which serves the same purpose as the monitoring device 14 in the apparatus of FIGS. 2 and 3. The monitoring device 214 is nearer to the end 1*c* of the roll 1 than the cooling device 230. The axis D of the roll 1 which cooperates with the apparatus including the structure of FIG. 5 is assumed to be horizontal, the end 1*c* of such roll is assumed to be located to the left and the end 1*b* of such roll is assumed to be located to the right of the support 212.

The units 231 can be activated to uniformly cool the adjacent portions of the respective end of the elastic layer 6. The axial length of the cooled portion of the roll 1 depends on the number of units 231 which are activated to perform a cooling action.

A circuit arrangement which can be utilized in an apparatus embodying the structure of FIG. 5 is shown diagrammatically in FIG. 6. The control circuit 45 for the prime mover 13 (assumed to be a reversible electric motor) receives signals from the monitoring device 214 which tracks the marginal portion 7 or 7a of the running web 4. The control circuit 45 evaluates the signals from the monitoring device 214 and sets the prime mover 13 in operation to move the support 212 in the axial direction of the roll 1 (not shown in FIG. 6) until the monitoring device 214 assumes a predetermined position relative to the adjacent marginal portion 7 or 7a of the running web. If the monitoring device 214 includes or constitutes an optical detector, the radiation source of such detector transmits one or more beams of radiation which is reflected by a reflector (such as the reflector 36 of the monitoring device 14) so that the reflected beam or beams impinge upon and are intercepted by the running web when the position of the marginal portion 7 or 7a of the web is such that it extends between the signal generating unit and the reflector of the optical detector (note the position of the marginal portion 7 of the web in the apparatus of FIG. 2). Alternatively, the position of the monitoring device 214 relative to the adjacent marginal portion 7 or 7a of a running web can be such that radiation which is reflected by the reflector can reach the signal generating unit of the device 214 because such radiation is not intercepted by the running web. This indicates that the position of the support 212 must be changed in the axial direction of the web 1, and the signal or signals from the monitoring device 214 initiate such operation of the prime mover 13 by way of the control circuit 45 Optical detectors of the just outlined character are well known and are readily available in all sizes, shapes and qualities. They can be designed and mounted to track the positions of the marginal portions 7 and 7a of a running web with a very high degree of accuracy.

The adjusting means for the individually activatable and deactivatable cooling units 231 of the cooling device 230 shown in FIGS. 5 and 6 can include discrete solenoid-operated or other suitable valves 46, at least one for each cooling unit 231, and an adjusting circuit 47 which can cause one or more valves 46 to open and to thus connect the respective cooling unit or units 231 to the sources (not shown) of gaseous and liquid coolants. The adjusting circuit 47 can include a conventional signal comparing stage having a first input connected with the output of the sensing device 44 and a second input connected with the output of the temperature measuring device 234. If the intensity or another characteristic of the signal from the device 234 (such signal denotes the actual temperature of the respective end portion of the elastic layer 6) departs from the corresponding characteristic of the reference signal from the sensing device 44 (such signal denotes the temperature of the overlapped central portion of the layer 6), the circuit 47 initiates the opening of one or more valves 46 with attendant activation of the respective cooling unit or units 231.

A further input of the adjusting circuit 47 is connected with the output of a position monitoring device 48 (denoted in FIG. 6 by a broken line) which transmits signals denoting the actual position of the support 212. The intensity or another characteristic of the signal from the position monitoring device 48 is indicative of the width of the respective non-overlapped portion 9 or 10 of the peripheral surface 1a of the roll Thus, the adjusting circuit 47 can select the number of cooling devices 231 to be activated in dependency on a number of parameters including the extent of departure of the temperature of the elastic layer 6 at the portion 9 or 10 from a reference value (sensing device 44) and the width of the respective non-overlapped portion 9 or 10.

The valves 46 can further serve to regulate the intensity of the cooling action of the respective devices 231, i.e., the quantities of gaseous and/or liquid coolants which are discharged by the respective devices 231 per unit of time. Such regulation is also controlled by the adjusting circuit 47.

FIG. 6 further shows a device 49 which is connected to the output of the temperature measuring device 234 and generates a detectable (e.g., visible and/or audible) alarm signal when the temperature of the elastic layer 6 at the non-overlapped portion 9 or 10 of the peripheral surface 1a of the roll 1 rises above a maximum permissible value.

The circuit arrangement which is shown in FIG. 6 can be simplified for use in an apparatus embodying the structure of FIG. 4. The valves 46 in the arrangement of FIG. 6 are then replaced by simple electric switches which activate or deactivate the respective cooling units 131 but need not regulate the cooling action of such units.

The circuit arrangement for use in an apparatus of the type shown in FIGS. 2 and 3 is even simpler than the just described circuit arrangements.

An important advantage of the improved apparatus is that the cooling device 30, 130 or 230 is automatically maintained at an optimum distance from the adjacent marginal portion 7 or 7a of the running web 4. This is due to the fact that the monitoring device (such as 14 or 214) tracks the marginal portion 7 or 7a and causes the prime mover 13 to shift the support 12, 112 or 212 along the path which is defined by the beam 20 until the monitoring device (such as 14) reaches the prescribed optimum position relative to the marginal portion 7. The distance of the cooling device 30 from the marginal portion 7 when the support 12 is arrested (i.e., when the monitoring device 14 is maintained in an optimum position relative to the marginal portion 7) is preferably selected in such a way that the device 30 can properly cool the adjacent end portion of the elastic layer 6 all the way to the plane of the marginal portion 7, i.e., that the elastic layer 6 cannot be overheated in a region immediately adjacent the portion which is overlapped by the web 4 and is adjacent the marginal portion 7. Furthermore, the width of the zone which is cooled by the device 30 suffices to ensure that the end portion of the layer 6 is adequately cooled all the way from the marginal portion 7 of the web 4 to the corresponding end 1b of the roll 1. In other words, the device 30 is effective within a certain zone extending in the direction of the axis D and having a width which is required to prevent undue overheating of the adjacent end portion of the elastic layer 6 regardless of the distance of the marginal portion 7 from the end 1b.

Another important advantage of the improved apparatus is that it automatically tracks the marginal portion 7 or 7a in a direction toward the end 1b or toward the end 1c of the roll to thus ensure automatic adjustment of the width of the zone which is cooled by the cooling device (e.g., the device 30) regardless of whether the width of the portion 10 varies as a result of replacement of a web 4 having a first width B with a web having a different second width and/or as a result of migration of the marginal portion 7 forming part of a running web 4 toward the end 1*b* or 1*c*.

The provision of the temperature measuring device 34, 134 or 234 constitutes an optional but highly desirable and advantageous feature of the improved apparatus. This temperature measuring device renders it possible to regulate the cooling action upon the adjacent end portion of the elastic layer 6 not only as a result of shifting of the position of the cooling device (e.g., the device 30) in the direction of the axis D but to also adjust the intensity of the cooling action which is furnished by the device 30. The feature that the temperature measuring device (such as 34) is also mounted on the support 12 exhibits the advantage that the device 34 can ascertain the temperature of the adjacent end portion of the layer 6 at an optimum distance from the cooling device 30.

The temperature measuring or sensing device 44 ensures that the temperature of the elastic layer is uniform or at least substantially uniform all the way from the marginal portion 7*a* to the end 1*b* of the roll 1 shown in FIGS. 1–3. Thus, the device 34 ascertains or monitors the temperature of the overlapped portion of the elastic layer 6, and its signals influence the means for adjusting the cooling device 30 so that the temperature of that end portion of the layer 6 which is surrounded by the non-overlapped portion 10 of the peripheral surface 1*a* matches or is properly related to the temperature of the overlapped central portion of the layer 6. Uniform or predictable heating of the roll 1 all the way between the ends 1*b* and 1*c* is desirable and advantageous in most instances irrespective of the exact nature of treatment of the web 4 which is caused to pass through the nip 3 of the rolls 1 and 2.

The provision of a cooling device (130 or 230) which employs several discrete cooling units is often desirable and advantageous on the ground that this renders it possible to regulate the cooling action with an even higher degree of accuracy. The adjustment can be carried out by changing the number of activated individually activatable cooling units 131 or 231 and/or by changing the intensity of the cooling action of some or all discrete cooling units and/or by selecting those cooling units which are activated in a particular position of the support 12, 112 or 212, i.e., in dependency on the width of the non-overlapped portion 9 or 10 of the peripheral surface 1*a* of the roll 1. For example, the cooling action of the single nozzle 31 of the cooling device 30 shown in FIGS. 1 to 3 can be regulated, either continuously or stepwise, by utilizing an adjustable blower (not shown) which supplies compressed gaseous fluid via conduit 32. The same result can be achieved by utilizing a source of compressed gaseous fluid and a valve which is installed in the conduit 32 and is adjustable to select the quantity of gaseous fluid which is directed against the non-overlapped portion 10 of the peripheral surface 1*a* per unit of time. The same applies for regulation of the quantity of liquid coolant (such as water) which is supplied via conduit 33, i.e., such conduit can contain a regulating valve which is adjustable in response to signals from the temperature measuring device 34 to select the cooling action of the hydraulic fluid upon that portion of the elastic layer 6 which is surrounded by the portion 10 of the peripheral surface 1*a*.

The device 49 of FIG. 6 can be used to furnish a visible, audible and/or other signal when the temperature of the respective end portion of the elastic layer rises above the maximum permissible value, as well as to automatically arrest the main drive of the calender (such as the means for rotating the rolls 1 and 2) and/or to automatically reduce the temperature of the finishing roll 2, i.e., to avoid overheating of the elastic layer 6 of the roll 1.

The illustrated prime mover 13 and/or 13*a* can be replaced with a linear motor. The linear motor can comprise a hydraulically or pneumatically operated unit with a reciprocable piston rod which pushes or pulls the support 12, 112 or 212 along its path. It is also possible to employ an electric or other linear motor without departing from the spirit of the invention.

The improved apparatus is susceptible of numerous additional modifications without departing from the spirit of the invention. For example, the aforedescribed nozzles 31, 131 and 231 which are designed to discharge gaseous and hydraulic coolants can be replaced by simpler nozzles which are designed to merely discharge a gaseous coolant or a liquid coolant. Furthermore, it is also possible to employ cooling devices of the type embodying one or more plenum chambers (boxes) with one or more orifices to discharge jets or streams of a suitable coolant. Furthermore, the means for adjusting the nozzle or nozzles (to thereby vary the cooling action upon the end portions of the elastic layer at the non-overlapped portions 9 and 10 of the peripheral surface 1*a*) can include means for moving the nozzles radially of the roll 1*a* toward or away from the respective portions 9, 10 of the peripheral surface 1*a*. Such adjustments can be carried out in addition to or in lieu of the aforediscussed adjustments of cooling action.

A device for monitoring the marginal portion of a running web is disclosed in the aforediscussed published German patent application Serial No. 39 07 216 A1 of Kalliola. However, the monitoring device of Kalliola is stationary.

Austrian Pat. No. 283899 granted Aug. 25, 1970 to Brunnschweiler discloses a gloss calender wherein a temperature measuring device is reciprocable axially of and along a roll. Signals which are transmitted by the mobile temperature monitoring device are used to regulate the cooling action of stationary air discharging nozzles.

German Utility Model No. G 90 16 548.9 to J. M. Voith GmbH (published Apr. 4, 1991) discloses a calender roll which is cooled by fluid discharging nozzles forming several rows extending all the way between the axial ends of the roll.

European patent application Serial No. 0 235 698 of Taylor et al. (published Sep. 9, 1987) discloses an "Evaporative-cooling apparatus and method for the control of web or web-production of machine component surface temperatures." The inventors propose to employ such apparatus to alter the temperature profile of the web being produced or of the surface of one or more calender rolls.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a machine wherein running webs having pairs of longitudinally extending marginal portions and different widths at least partially overlap a peripheral surface extending between two ends of a roll which is rotatable about a predetermined axis and the width of the non-overlapped portion of the peripheral surface at least at one end of the roll varies when a web having a first width is followed by a web having a different second width, apparatus for thermally influencing the roll at the non-overlapped portion of the peripheral surface comprising guide means defining a path extending in substantial parallelism with the axis of the roll; means for cooling the roll at the non-overlapped portion of the peripheral surface, said cooling means being movable along said path; means for monitoring those marginal portions of running webs which are adjacent the non-overlapped portion of the peripheral surface of the roll, said monitoring means being movable with said cooling means and including means for generating signals denoting the position of said monitoring means relative to that marginal portion of a running web which is adjacent the non-overlapped portion of the peripheral surface of the roll; and means for moving said cooling means and said monitoring means along said path in response to said signals until the monitoring means assumes a predetermined position relative to that marginal portion of the monitored web which is adjacent the non-overlapped portion of the peripheral surface of the roll.

2. The apparatus of claim for thermally influencing a roll having an elastic layer adjacent the peripheral surface, wherein said cooling means is disposed between said monitoring means and the one end of the roll as seen in the direction of said axis.

3. The apparatus of claim wherein said cooling means is adjustable and further comprising means for measuring the temperature of the roll at the non-overlapped portion of the peripheral surface, said temperature measuring means being movable with said cooling means and including means for generating second signals denoting the measured temperature of the roll, and further comprising means for adjusting said cooling means in response to said second signals.

4. The apparatus of claim 3, wherein said moving means comprises a common support for said monitoring, cooling and measuring means and means for moving said support along said path.

5. The apparatus of claim 3, wherein said temperature measuring means comprises at least one source of infrared radiation.

6. The apparatus of claim 3, further comprising means for sensing the temperature of the roll in the region of overlapped portion of the peripheral surface including means for generating third signals denoting the temperature of the roll in the region of overlapped portion of the peripheral surface, said adjusting means including means for adjusting said cooling means as a function of variations of said second and third signals.

7. The apparatus of claim wherein said cooling means comprises a plurality of independently activatable and deactivatable cooling units and further comprising means for measuring the temperature of the roll at the non-overlapped portion of the peripheral surface, said temperature measuring means being movable with said cooling means and including means for generating second signals denoting the measured temperature of the roll at the non-overlapped portion of the peripheral surface, and means for adjusting said cooling means in response to said second signals so that the number of activated cooling units is a function of the measured temperature of the roll at the non-overlapped portion of the peripheral surface.

8. The apparatus of claim 1, further comprising means for ascertaining the temperature of the roll at the non-overlapped portion of the peripheral surface, including means for generating a detectable signal when the ascertained temperature exceeds a preselected value.

9. The apparatus of claim 1, wherein said cooling means comprises a plurality of individually activatable and deactivatable cooling units spaced apart from one another in the axial direction of the roll, and further comprising means for activating different numbers of said cooling units in different positions of said cooling means relative to said path.

10. The apparatus of claim 1, wherein said moving means comprises a support for said monitoring means and said cooling means, and a prime mover having means for moving said support along said path.

11. The apparatus of claim 1, wherein said means for moving said support along said path includes a motor having a rotary output element provided with an external thread mating with an internally threaded portion of said support.

12. The apparatus of claim wherein said motor is a reversible motor and said output element comprises a feed screw.

13. The apparatus of claim wherein said moving means comprises a linear motor.

14. The apparatus of claim wherein said moving means includes means for moving said cooling means and said monitoring means to inoperative positions in which the one end of the roll is located between the peripheral surface and at least one of said cooling and monitoring means.

15. The apparatus of claim wherein said moving means comprises a support for said monitoring and cooling means and means for moving said support along said path between a plurality of positions including a position in which the one end of the roll is located between said support and the peripheral surface as seen in the axial direction of the roll.

16. The apparatus of claim wherein said cooling means is adjustable and further comprising means for sensing the temperature of the roll in the region of overlapped portion of the peripheral surface of the roll including means for generating further signals denoting the temperature of the roll in the region of the overlapped portion of the peripheral surface, and means for adjusting said cooling means as a function of variations of said further signals.

17. The apparatus of claim 1, for use in a machine wherein the peripheral surface of the roll has a non-overlapped portion at each end of the roll and the width of each non-overlapped portion varies when a web having a first width is followed by a web having a different second width, further comprising second guide means defining a second path extending in substantial parallelism with the axis of the roll along the non-overlapped portion of the peripheral surface adjacent the other end of the roll, second cooling means movable along said second path and including means for cooling the roll at the non-overlapped portion of the peripheral surface adjacent the other end of the roll, and second monitoring means including means for monitoring those marginal portions of running webs which are adjacent the non-overlapped portion of the peripheral surface at the other end of the roll, said second monitoring means being movable with said second cooling means and including means for generating signals denoting the position of said second monitoring means relative to that marginal portion of a running web which is adjacent the non-overlapped portion of the peripheral surface at the other end of the roll, and further comprising second moving means including means for moving said second cooling means and said second monitoring means along said second path in response to signals from said second monitoring means until the second monitoring means assumes a predetermined position relative to that marginal portion of the monitored web which is adjacent the non-overlapped portion of the peripheral surface at the other end of the roll.

* * * * *